US011873719B2

(12) United States Patent
Yuan et al.

(10) Patent No.: US 11,873,719 B2
(45) Date of Patent: Jan. 16, 2024

(54) GAS-LIQUID SPRAY DUST SETTLEMENT SYSTEM FOR FULLY MECHANIZED MINING FACE

(71) Applicants: Anhui University of Science and Technology, Anhui (CN); PINGAN COAL MINING ENGINEERING RESEARCH INSTITUTE CO., LTD., Anhui (CN)

(72) Inventors: Liang Yuan, Anhui (CN); Qinghua Chen, Anhui (CN); Bingyou Jiang, Anhui (CN); Jinwei Qiu, Anhui (CN); Mingyun Tang, Anhui (CN); Bo Ren, Anhui (CN); Mingqing Su, Anhui (CN)

(73) Assignees: ANHUI UNIVERSITY OF SCIENCE AND TECHNOLOGY, Anhui (CN); PINGAN COAL MINING ENGINEERING RESEARCH INSTITUTE CO., LTD., Anhui (CN)

( * ) Notice: Subject to any disclaimer, the term of this patent is extended or adjusted under 35 U.S.C. 154(b) by 144 days.

(21) Appl. No.: 17/616,875

(22) PCT Filed: Jul. 14, 2020

(86) PCT No.: PCT/CN2020/101800

§ 371 (c)(1),
(2) Date: Dec. 6, 2021

(87) PCT Pub. No.: WO2021/227238

PCT Pub. Date: Nov. 18, 2021

(65) Prior Publication Data

US 2022/0316336 A1 Oct. 6, 2022

(30) Foreign Application Priority Data

May 28, 2020 (CN) ..... 202010468946.6

(51) Int. Cl.
*E21F 5/04* (2006.01)
*E21C 35/22* (2006.01)

(52) U.S. Cl.
CPC ..... *E21F 5/04* (2013.01); *E21C 35/22* (2013.01)

(58) Field of Classification Search
CPC ..... E21F 5/04; E21C 32/22
See application file for complete search history.

(56) References Cited

U.S. PATENT DOCUMENTS 11,028,693 B2 * 6/2021 Nie ..... E21F 5/20

FOREIGN PATENT DOCUMENTS

CN 204140073 U 2/2015
CN 105626134 A 6/2016
(Continued)

*Primary Examiner* — Janine M Kreck
(74) *Attorney, Agent, or Firm* — MUNCY, GEISSLER, OLDS & LOWE, P.C.

(57) ABSTRACT

A gas-liquid spray dust settlement system for a fully mechanized mining face includes an atomization humidification subsystem, a boundary mist curtain subsystem, and a dust mist recycling subsystem that are all arranged outside the fully mechanized mining face, where the boundary mist curtain subsystem includes high-pressure blade nozzles mounted to hydraulic supports. The atomization humidification subsystem includes a spray dust settler mounted to a rocker arm of a coal cutter and configured to spray water mist completely covering the high-pressure blade nozzle. The dust mist recycling subsystem includes a wind-water linkage dust remover mounted to a semi-encircling support base, arranged under the spray dust settler, and configured to collect the water mist sprayed by the spray dust settler.

8 Claims, 7 Drawing Sheets

(56) References Cited

FOREIGN PATENT DOCUMENTS

| | | | | | |
|---|---|---|---|---|---|
| CN | 206205927 | U | | 5/2017 | |
| CN | 206256925 | U | | 6/2017 | |
| CN | 206655696 | U | | 11/2017 | |
| CN | 108930549 | A | | 12/2018 | |
| CN | 208546168 | U | | 2/2019 | |
| CN | 210164497 | U | | 3/2020 | |
| CN | 112012781 | A | * | 12/2020 | ..... E21F 5/00 |
| JP | S51122602 | A | | 10/1976 | |
| WO | WO-2020006816 | A1 | * | 1/2020 | ..... E21C 35/22 |

* cited by examiner

GAS-LIQUID SPRAY DUST SETTLEMENT SYSTEM FOR FULLY MECHANIZED MINING FACE

TECHNICAL FIELD

The present invention relates to the field of dust settlement systems, and in particular, to a gas-liquid spray dust settlement system for a fully mechanized mining face.

BACKGROUND

A fully mechanized mining face is one of main dust sources of an underground coal mine. With the development of coal mining technologies, large-scale coal cutters are widely used, producing an increasing amount of coals. High-intensity coal mining results in high-concentration dust, bringing a great threat to body health of operators on site. In addition, the high-concentration dust may also lead to accidents such as a dust explosion, which seriously impairs production safety. Therefore, it is urgent to minimize a dust concentration of the fully mechanized mining face.

In an actual mining environment, a complex distribution of flow field is a main factor affecting dust control. In an existing dust settlement method, mere spraying is performed on a dust source for humidification and settlement, and there is no closed space and dust recycling system, which has a poor dust settlement effect and may result in secondary pollution. An underground dust settler usually adopts a copper nozzle, which sprays a wide range of water mist, adversely affecting an operation sight of a worker and increasing an operation difficulty.

For example, a dust settlement system device and method for a fully mechanized mining face in Chinese Patent Application No. 201810077570.9, filed on Aug. 31, 2018 and entitled "DUST SETTLEMENT SYSTEM DEVICE AND METHOD FOR FULLY MECHANIZED MINING FACE" is applicable to a fully mechanized mining face having a large amount of dust during coal cutting by a coal cutter. The device of the present invention includes a coal cutter dust settlement assembly disposed on the coal cutter and a hydraulic support dust settlement assembly disposed on a hydraulic support. The device is a remake based on an existing coal cutter. A dust concentration detection sensor senses a concentration of dust, and the dust settlement assembly is automatically started and stopped, to intercept and wet dust generated during coal cutting by the coal cutter and dust of a coal wall and a fully mechanized mining face by using a water curtain, which are finally settled, thereby controlling the dust concentration of the fully mechanized mining face. In this way, the dust concentration of the fully mechanized mining face is reduced to some extent. However, this application has no recycling device, and uses an annular nozzle which sprays at a relatively wide range. A visibility of a working area is worsened, and a dust settling effect needs further enhancement.

For another example, Chinese Patent Application No. 201811107811.6, filed on Dec. 18, 2018 and entitled "COMPREHENSIVE TREATMENT METHOD FOR COAL-CUTTING COAL DUST PRODUCED BY COAL CUTTER AGAINST WIND ON FULLY MECHANIZED MINING FACE" discloses a comprehensive treatment method for coal-cutting coal dust produced by a coal cutter against wind on a fully mechanized mining face. First, broken coals that collapsed from and near front and rear drums of a coal cutter are quickly wet by using a first sprayer, then flying dust is guided to move down along a side of a coal wall by using a dust curtain, a second sprayer, and a third sprayer, and then high-concentration dust-containing air flows guided to move along the side of the coal wall are collectively and efficiently purified by using a fourth sprayer and a fifth sprayer, and finally, escaping dust is settled by using a sixth sprayer, thereby improving dust settlement efficiency. However, this application lacks dust settlement for personnel operating areas and has a poor dust purification effect, and therefore still needs to be improved for efficient and comprehensive dust settlement.

SUMMARY

For the deficiency of the prior art, the present invention provides a gas-liquid spray dust settlement system for a fully mechanized mining face. The system can effectively control dust generated from the fully mechanized mining face, thereby reducing a dust concentration of a coal mining area to a great extent.

The objective of the present invention can be achieved by the following technical solution:

A gas-liquid spray dust settlement system for a fully mechanized mining face includes an atomization humidification subsystem, a boundary mist curtain subsystem, and a dust mist recycling subsystem that are all arranged outside the fully mechanized mining face, where the boundary mist curtain subsystem includes high-pressure blade nozzles mounted to hydraulic supports, the atomization humidification subsystem includes a spray dust settler mounted to a rocker arm of a coal cutter and configured to spray water mist completely covering the high-pressure blade nozzle, the dust mist recycling subsystem includes a wind-water linkage dust remover mounted to a semi-encircling support base, arranged under the spray dust settler, and configured to collect the water mist sprayed by the spray dust settler.

Further, the spray dust settler is fixed to the rocker arm by using a spray dust settler support base, the spray dust settler support is mounted to the semi-encircling support base, and the spray dust settler is configured to adjust a spraying angle by using a hydraulic rod.

Further, the semi-encircling support base includes an upper spoon-shaped support base and a lower stepped support base that are fixed by using a combination of bolt connection and spot welding.

Further, the boundary mist curtain subsystem is composed of the high-pressure blade nozzles mounted to the hydraulic supports, and the high-pressure blade nozzles spray to generate water mist curtains.

Further, three high-pressure blade nozzles: a first high-pressure blade nozzle, a second high-pressure blade nozzle, and a third high-pressure blade nozzle are mounted to each of the hydraulic supports, the first high-pressure blade nozzle is mounted to a side of a jack support base for a top beam guard plate that is away from the fully mechanized mining face, the second high-pressure blade nozzle is mounted inside a left top beam guard plate, and the third nozzle is mounted inside a right top beam guard plate.

Further, the second high-pressure blade nozzle is configured to generate a water mist curtain perpendicular to the fully mechanized mining face, and the third high-pressure blade nozzle is configured to generate a water mist curtain perpendicular to the fully mechanized mining face.

Further, the wind-water linkage dust remover includes a wind-water linkage dust removal fan, a block, and a flow-guiding groove, and the wind-water linkage dust removal fan is mounted to the semi-encircling support base by using a fixing bracket.

Further, the gas-liquid spray dust settlement system for a fully mechanized mining face is a closed-loop system composed of the atomization humidification subsystem and the dust mist recycling subsystem, and a closed working boundary is formed by using the boundary mist curtain subsystem. Compared with the prior art, the beneficial effects of the present invention are embodied as follows.

The present invention provides a gas-liquid spray dust settlement system for a fully mechanized mining face which combines humidification and settling, dust mist recycling, and the boundary curtain. The water curtain is established to enclose the dust generated by the fully mechanized mining face in a closed area for settlement and recycling, so that a dust settling effect is greatly improved, and a dust concentration of the fully mechanized mining face or even an entire mining area is effectively controlled.

BRIEF DESCRIPTION OF THE DRAWINGS

The following further describes the present invention in detail with reference to the accompanying drawings.

Figure 1:
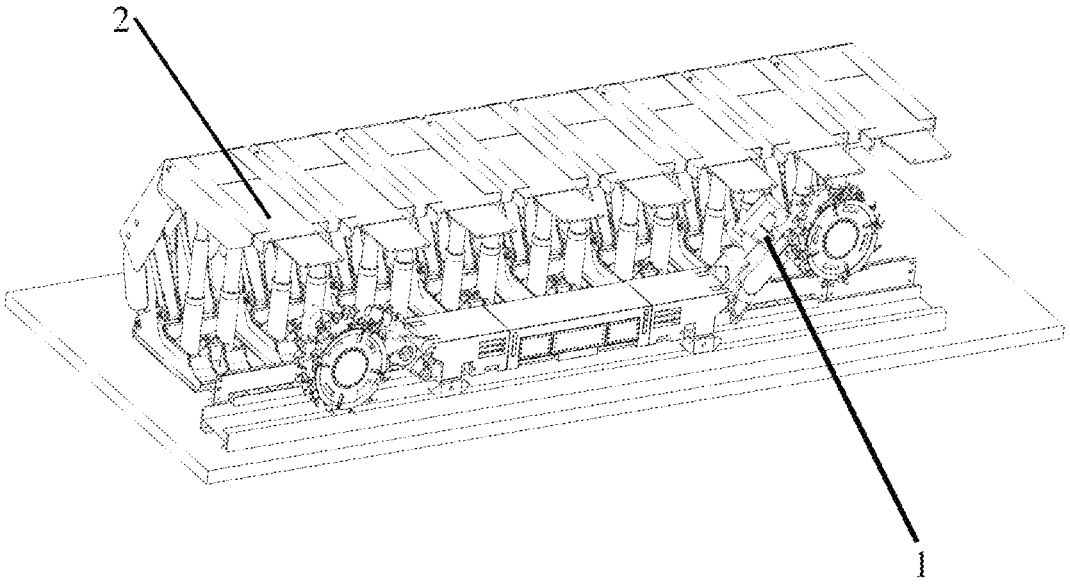
FIG. 1 is a schematic diagram of a gas-liquid spray dust settler for a fully mechanized mining face according to the present invention.
Figure 2:
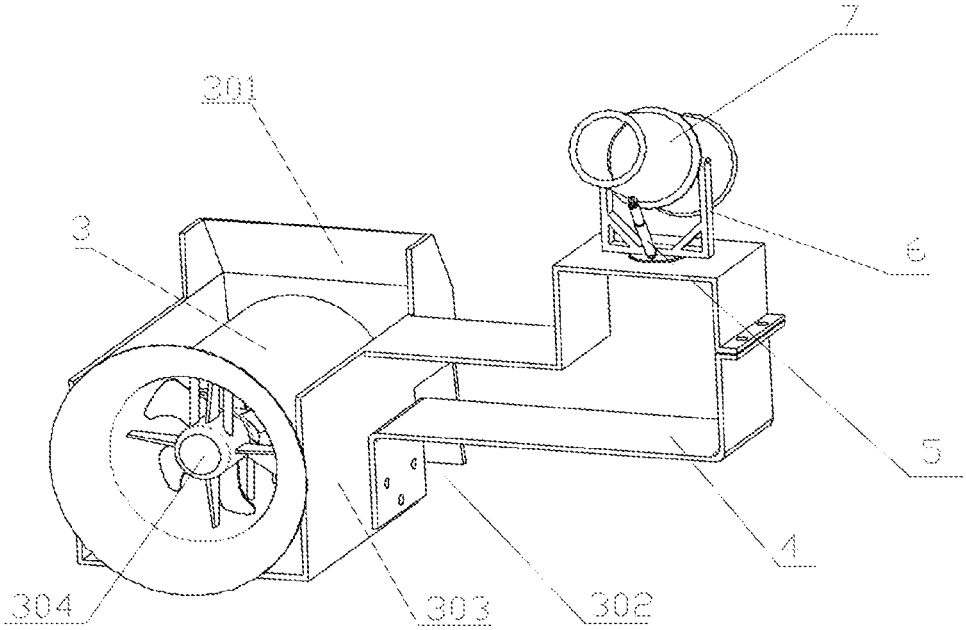
FIG. 2 is a schematic diagram of positions of a semi-encircling support base and two dust settlers according to the present invention.
Figure 3:
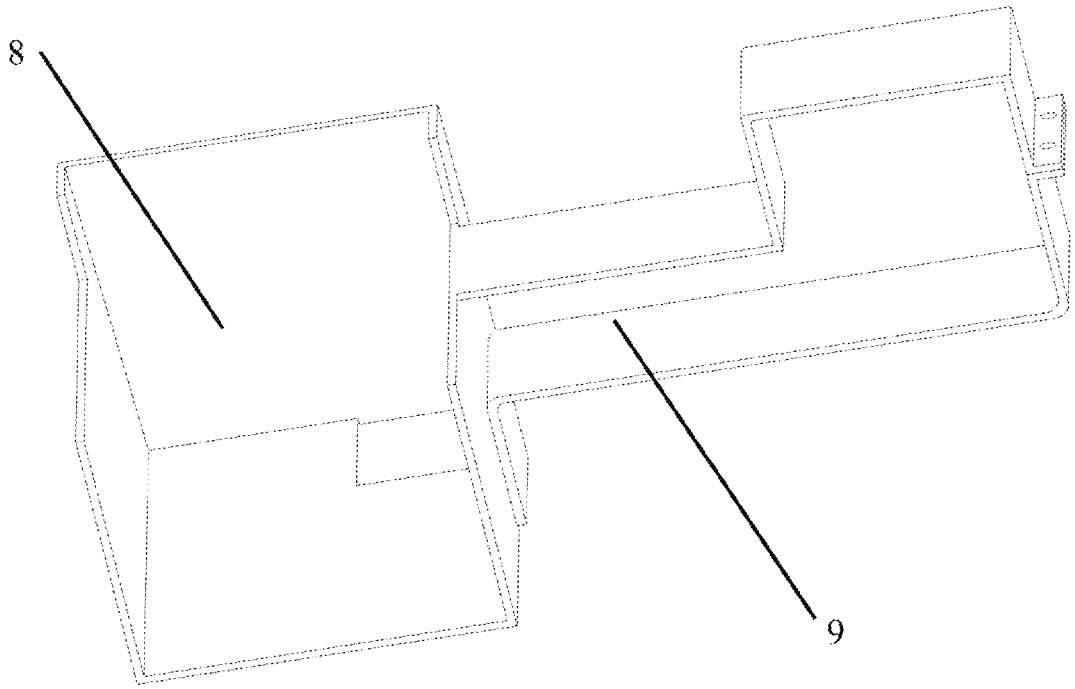
FIG. 3 is a schematic device diagram of the semi-encircling support base according to the present invention.
Figure 4:
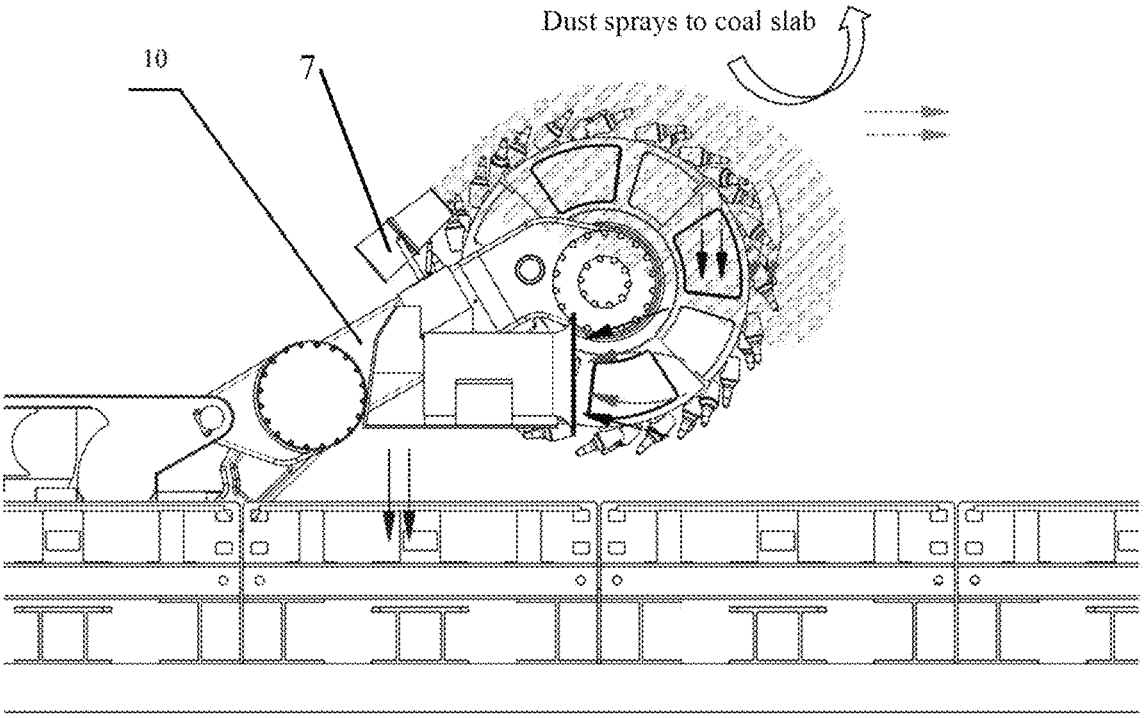
FIG. 4 is a schematic effect diagram of spray dust settlement and a passive suction dust settlement subsystem according to the present invention.

Components corresponding to reference numerals in the figures are as follows:

1—Atomization humidification subsystem; 2—Sprayer hydraulic support; 3—Wind-water linkage dust remover; 4—Semi-encircling support base; 5—Hydraulic rod; 6—Spray dust settler support; 7—Spray dust settler; 8—Upper spoon-shaped support base; 9—Lower stepped support base; 10—Rocker arm; 11—First high-pressure blade nozzle; 12—Second high-pressure blade nozzle; 13—Third high-pressure blade nozzle; 14—Top beam left guard plate; 15—Top beam right guard plate; 16—Jack support base; 17—Vertical curtain; 18—Parallel curtain; 19—Boundary mist curtain subsystem.

DETAILED DESCRIPTION

The following clearly and completely describes the technical solutions in the embodiments of the present invention with reference to the accompanying drawings in the embodiments of the present invention. Apparently, the described embodiments are some of the embodiments of the present invention rather than all of the embodiments. Based on the embodiments of the invention, all other embodiments obtained by those of ordinary skill in the art without going through any creative work shall fall within the scope of protection of the invention.

In the description of the present invention, it should be understood that orientation or position relationships indicated by the terms such as "hole", "above", "below", "thickness", "top", "middle", "length", "inside", and "around" are used only for ease and brevity of illustration and description, rather than indicating or implying that the mentioned component or element need to have a particular orientation or need to be constructed and operated in a particular orientation. Therefore, such terms should not be construed as limiting of the present invention.

As shown in FIG. 1 to FIG. 7, a gas-liquid spray dust settlement system for a fully mechanized mining face includes an atomization humidification subsystem 1, a boundary mist curtain subsystem 19, and a dust mist recycling subsystem that are all arranged outside the fully mechanized mining face. The boundary mist curtain subsystem 19 includes high-pressure blade nozzles mounted to hydraulic supports. The atomization humidification subsystem 1 includes a spray dust settler 7 mounted to a rocker arm 10 of a coal cutter and configured to spray water mist completely covering the high-pressure blade nozzle. The dust mist recycling subsystem includes a wind-water linkage dust remover 3 mounted to a semi-encircling support base 4 arranged under the spray dust settler 7 and configured to collect the water mist sprayed by the spray dust settler 7. More specifically, during coal mining on the fully mechanized mining face, dust spreads outward along the fully mechanized mining face. By means of the high-pressure blade nozzle and the spray dust settler 7, a water mist area is formed, to block and capture the dust spreading outward. In addition, the wind-water linkage dust remover 3 is disposed under the spray dust settler 7 to collect water mist sprayed by the spray dust settler 7, so that the water mist is gathered, settled and finally discharged out of the system. Moreover, the wind-water linkage dust remover 3 may suck dust escaping from the upper water mist and discharge the dust out of the system along with the collected water mist.

It may be understood that, by means of the combination of the atomization humidification subsystem 1, the boundary mist curtain subsystem 19, and the dust mist recycling subsystem, the system realizes spraying for settlement, collection and discharge of water mist, and capture of escaped dust, to prevent the dust from escaping from the water mist. The system sucks the water mist, the dust captured by the water mist, and the dust escaping from the water mist, thereby sufficiently settling the dust and the water mist.

Furthermore, the spray dust settler 7 is fixed to the rocker arm 10 by using a spray dust settler support base 6. The spray dust settler support base 6 is mounted to the semi-encircling support base 4. The spray dust settler 7 is configured to adjust a spraying angle by using a hydraulic rod 5.

Furthermore, the semi-encircling support base 4 includes an upper spoon-shaped support base 8 and a lower stepped support base 9 that are fixed by using a combination of bolt connection and spot welding.

Figure 5:
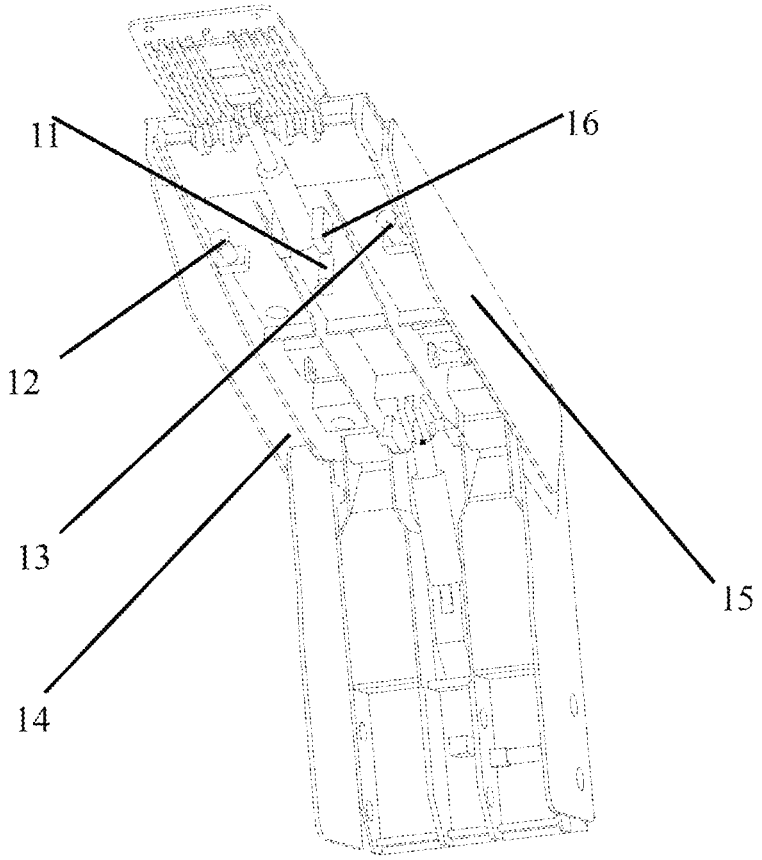
FIG. 5 is a schematic diagram of a position of a high-pressure blade nozzle mounted to a hydraulic support according to the present invention.

As shown in FIG. 5, the boundary mist curtain subsystem composed of the high-pressure blade nozzles mounted to the hydraulic supports. Three high-pressure blade nozzles: a first high-pressure blade nozzle 11, a second high-pressure blade nozzle 12, and a third high-pressure blade nozzle 13 are mounted to each of the hydraulic supports. The first high-pressure blade nozzle 11 is mounted to a side of a jack support base 16 for a top beam guard plate that is away from the fully mechanized mining face. The nozzle produces a curtain parallel to the fully mechanized mining face. The second high-pressure blade nozzle is mounted inside a left top beam guard plate 14. The nozzle produces a curtain perpendicular to the fully mechanized mining face. The third nozzle is mounted inside a right top beam guard plate 15, which produces a curtain perpendicular to the fully mechanized mining face.

Figure 6:
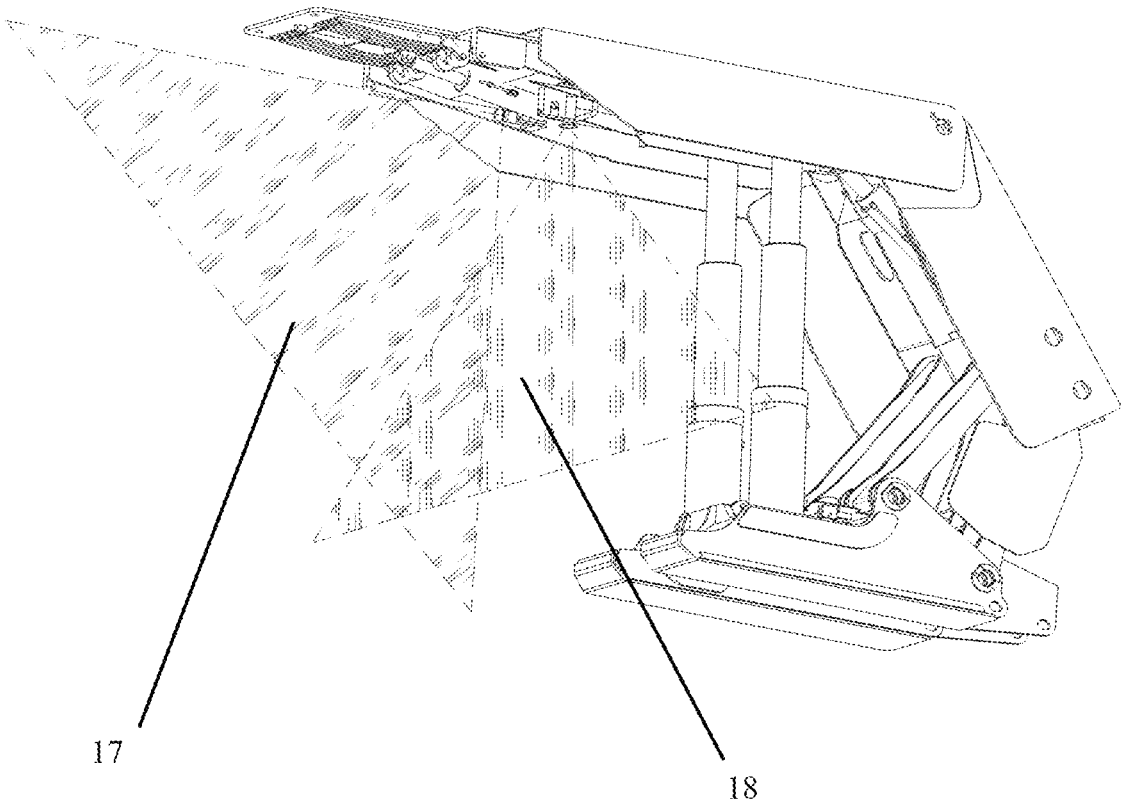
FIG. 6 is a schematic curtain diagram of a curtain hydraulic support according to the present invention.
Figure 7:
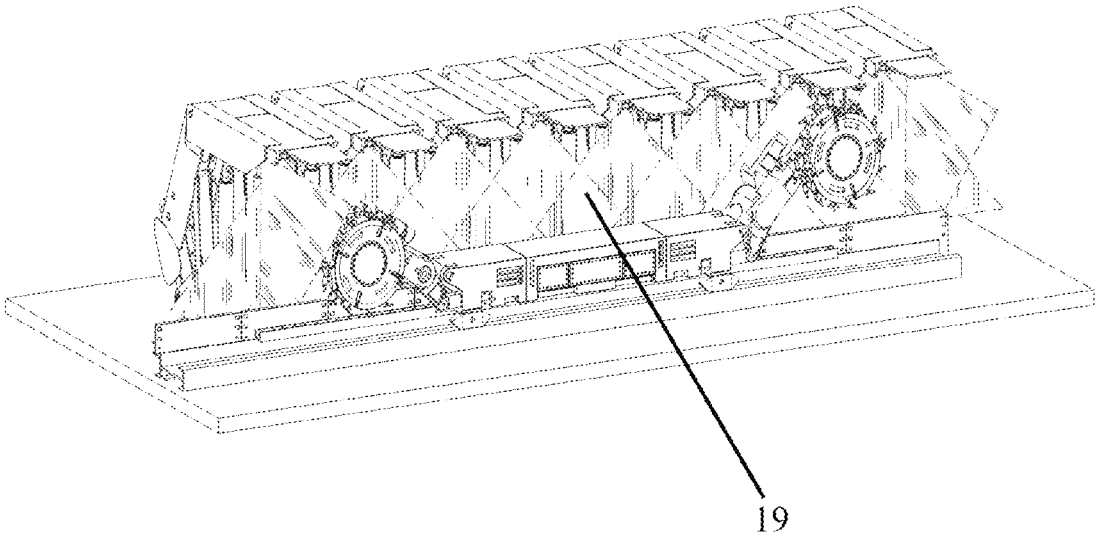
FIG. 7 is a schematic diagram of a gas-liquid spray dust settlement system for a fully mechanized mining face according to the present invention.

Specifically, as shown in FIG. 6 and FIG. 7, by disposing the first high-pressure blade nozzle 11, the second high-pressure blade nozzle 12, and the third high-pressure blade nozzle 13, continuous parallel curtains 18 and continuous vertical curtains 17 are formed to stop dust from spreading outward or along the fully mechanized mining face, thereby enhancing a dust settling effect.

In addition, the wind-water linkage dust remover 3 includes a wind-water linkage dust removal fan 304, a block 301, and a flow-guiding groove 302. The wind-water linkage dust removal fan 304 is mounted to the semi-encircling support base 4 by using a fixing bracket 303.

The gas-liquid spray dust settlement system 1 for a fully mechanized mining face is a closed-loop system including the atomization humidification subsystem and the dust mist recycling subsystem, where a closed working boundary is formed by using the boundary mist curtain subsystem.

In the descriptions of this specification, a description of a reference term such as "an embodiment", "an example", or "a specific example" means that a specific feature, structure, material, or characteristic that is described with reference to the embodiment or the example is included in at least one embodiment or example of the present invention. In this specification, exemplary descriptions of the foregoing terms do not necessarily refer to the same embodiment or example. In addition, the described specific features, structures, materials, or characteristics may be combined in a proper manner in any one or more of the embodiments or examples.

The foregoing displays and describes basic principles, main features of the present invention and advantages of the present invention. A person skilled in the art may understand that the present invention is not limited to the foregoing embodiments. Descriptions in the embodiments and this specification only illustrate the principles of the present invention. Various modifications and improvements are made in the present invention without departing from the spirit and the scope of the present invention, and these modifications and improvements shall fall within the protection scope of the present invention.

What is claimed is:

1. A gas-liquid spray dust settlement system for a fully mechanized mining face, comprising an atomization humidification subsystem, a boundary mist curtain subsystem, and a dust mist recycling subsystem, wherein the boundary mist curtain subsystem comprises high-pressure blade nozzles mounted to hydraulic supports, the atomization humidification subsystem comprises a spray dust settler mounted to a rocker arm of a coal cutter and configured to spray water mist completely covering the high-pressure blade nozzles, the dust mist recycling subsystem comprises a wind-water linkage dust remover mounted to a support base, arranged under the spray dust settler, and configured to collect the water mist sprayed by the spray dust settler.

2. The gas-liquid spray dust settlement system for a fully mechanized mining face according to claim 1, wherein the spray dust settler is fixed to the rocker arm by using a spray dust settler support, the spray dust settler support is mounted to the support base, and the spray dust settler is configured to adjust a spraying angle by using a hydraulic rod.

3. The gas-liquid spray dust settlement system for a fully mechanized mining face according to claim 1, wherein the support base comprises an upper support base and a lower stepped support base that are fixed by using a combination of bolt connection and spot welding.

4. The gas-liquid spray dust settlement system for a fully mechanized mining face according to claim 1, wherein the boundary mist curtain subsystem is composed of the high-pressure blade nozzles mounted to the hydraulic supports, and the high-pressure blade nozzles spray to generate water mist curtains.

5. The gas-liquid spray dust settlement system for a fully mechanized mining face according to claim 4, wherein three high-pressure blade nozzles: a first high-pressure blade nozzle, a second high-pressure blade nozzle, and a third high-pressure blade nozzle are mounted to each of the hydraulic supports, the first high-pressure blade nozzle is mounted to a side of a jack support base for a top beam guard plate, the second high-pressure blade nozzle is mounted inside a left top beam guard plate, and the third nozzle is mounted inside a right top beam guard plate.

6. The gas-liquid spray dust settlement system for a fully mechanized mining face according to claim 5, wherein the second high-pressure blade nozzle is configured to generate a water mist curtain perpendicular to the fully mechanized mining face, and the third high-pressure blade nozzle is configured to generate a water mist curtain perpendicular to the fully mechanized mining face.

7. The gas-liquid spray dust settlement system for a fully mechanized mining face according to claim 1, wherein the wind-water linkage dust remover comprises a wind-water linkage dust removal fan, a block, and a flow-guiding groove, and the wind-water linkage dust removal fan is mounted to the support base by using a fixing bracket.

8. The gas-liquid spray dust settlement system for a fully mechanized mining face according to claim 1, wherein the gas-liquid spray dust settlement system for a fully mechanized mining face is a closed-loop system composed of the atomization humidification subsystem, the boundary mist curtain subsystem and the dust mist recycling subsystem, and a closed working boundary is formed by using the boundary mist curtain subsystem.

* * * * *